US005080831A

United States Patent [19]

VanEenam

[11] Patent Number: 5,080,831

[45] Date of Patent: Jan. 14, 1992

[54] AQUEOUS CLEANER/DEGREASER COMPOSITIONS

[75] Inventor: Donald N. VanEenam, Des Peres, Mo.

[73] Assignee: Buckeye International, Inc., Maryland Heights, Mo.

[21] Appl. No.: 373,813

[22] Filed: Jun. 29, 1989

[51] Int. Cl.[5] ..... C11D 7/50; C23G 5/22

[52] U.S. Cl. ..... 252/558; 252/165; 252/170; 252/173; 252/114; 252/DIG. 14; 252/171

[58] Field of Search ..... 252/174.25, 174.24, 252/106, DIG. 1, DIG. 14, 148, 541, 170, 549, 171, 114, 173, 165, 558

[56] References Cited

U.S. PATENT DOCUMENTS

| | | | |
|---|---|---|---|
| 4,248,928 | 2/1981 | Spadini et al. | 252/99 |
| 4,264,466 | 4/1981 | Carleton et al. | 252/99 |
| 4,414,128 | 11/1983 | Goffinet | 252/111 |
| 4,758,377 | 7/1988 | Iding | 252/174.24 |
| 4,769,172 | 9/1988 | Siklosi | 252/153 |
| 4,861,512 | 8/1989 | Gosselink | 252/174.23 |

*Primary Examiner*—Prince Willis, Jr.
*Assistant Examiner*—J. Silbermann
*Attorney, Agent, or Firm*—Senniger, Powers, Leavitt & Roedel

[57] ABSTRACT

Improved stable, aqueous cleaner/degreaser compositions formulated in the form of totally water soluble solutions comprise:

(a) at least one sparingly water soluble organic solvent characterized by:
  (i) having a watersolubility in the range of approximately 0.2 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;

(b) a solubilizing additive consisting of from approximately 0.1 to approximately 100 weight percent of a surfactant and from 0 to approximately 99.9 weight percent of a coupler, the solubilizing additive being present in an amount not exceeding approximately tenfold that required to completely solubilize the organic solvent; and (c) water. Such compositions exhibit markedly superior cleaning/degreasing efficacy over that achievable with compositions containing infinitely water soluble organic solvents such as butyl cellosolve.

32 Claims, No Drawings

AQUEOUS CLEANER/DEGREASER COMPOSITIONS

BACKGROUND OF THE INVENTION

This invention relates to cleaner/degreaser compositions and, more particularly, to stable, aqueous cleaner/degreaser compositions in the form of totally water soluble solutions which exhibit superior cleaning and degreasing capability.

Heretofore, all of the conventional and available ready to use and concentrated water soluble, dilutable cleaner/degreaser compositions have expediently contained infinitely or highly water soluble organic solvents such as butyl cellosolve (ethylene glycol monobutyl ether), butyl carbitol (diethylene glycol monobutyl ether), ethyl carbitol, propylene glycol monomethyl ether, dipropylene glycol monomethyl ether or isopropanol together with anionic or nonionic surfactants and conventional adjuvants such chelants, builders, perfumes, dyes, pH adjustors, etc., these components falling generally within the following compositional wt. % ranges:

| | |
|---|---|
| 2-10% | Water soluble solvent(s) |
| 1-3% | Anionic or nonionic surfactant |
| 0.1-3% | Adjuvants |
| QS | Water |
| 100.0% | |

Such conventional compositions are generally deficient in cleaning action and especially in heavy duty grease, oil, wax, etc. cutting action, often smell objectionably strongly of volative solvent and can sometimes present conbustability problems in concentrated form. They also tend to be harsh on the hands and to defat the skin. Further, heavy scrubbing, mopping or other mechanical action is generally required to attain the desired cleaning/degreasing action, especially where excessive soilant buildup has occurred. Most, even in their concentrated form, are ineffective in their capability to remove graffiti or the like.

While not wishing to be held to any rigid theory as to the nature of the cleaning and degreasing action of presently available compositions, it is believed that highly or infinitely water soluble organic solvents presently used in both retail as well as industrial and institutional cleaner/degreaser compositions are too hydrophilic in nature to function effectively in removing hydrophobic (oleophilic) soilants, especially in the presence of diluting water. As the level of the latter is increased to bring conventional compositions to ready to use strength, the solvating action of the organic solvent is drastically reduced with a consequent and marked reduction in the cleaning/degreasing action required for effective cleaning and oily soilant removal.

There remains a need, therefore, for cleaner/degreaser compositions with improved cleaning and degreasing capability and without the other deficiencies of presently available cleaner/degreaser compositions.

RELATED APPLICATIONS

Related applications include copending and coassigned application Ser. No. 373,910 filed June 29, 1989, application Ser. No. 452,623, filed Dec. 19, 1989, and application Ser. No. 507,197, filed Apr. 10, 1990.

SUMMARY OF THE INVENTION

Among the several objects of the invention may be noted the provision of stable, aqueous cleaner/degreaser composition shaving superior cleaning/degreasing efficacy; the provision of such compositions which may be formulated to have a low level of odor and low volatility or a high flash point; the provision of compositions of this type which incorporate organic solvents with inherently limited aqueous solubility; the provision of such compositions which are nontoxic and nonhazardous in use; and the provision of such improved compositions which may be readily formulated from available components. Other objects and features will be in part apparent and in part pointed out hereinafter.

Briefly, the present invention is directed to stable, aqueous cleaner/degreaser compositions which are formulated in the form of totally water soluble solutions. The compositions comprise:

(a) at least one sparingly water soluble organic solvent characterized by:
  (i) having a water solubility in the range of approximately 0.2 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;

(b) a solubilizing additive consisting of from approximately 0.1 to approximately 100 weight percent of a surfactant and from 0 to approximately 99.9 weight percent of a coupler, the solubilizing additive being present in an amount not exceeding approximately twofold that required to completely solubilize the organic solvent; and (c) water.

The compositions of the invention exhibit markedly superior cleaning/degreasing efficacy over that achievable with compositions containing infinitely water soluble organic solvents such as butyl cellosolve and butyl carbitol.

DESCRIPTION OF THE PREFERRED EMBODIMENTS

In accordance with the present invention, it has now been found that stable, totally water soluble, aqueous cleaner/degreaser compositions having superior cleaning and degreasing capabilities can be formulated by combining at least one sparingly water soluble organic solvent having certain characteristics and being present in an amount exceeding its aqueous solubility with a solubilizing additive and water, the solubilizing additive being present in an amount not exceeding approximately tenfold that required to completely solubilize the organic solvent. Surprisingly, as demonstrated by the experimental data presented hereinafter, it has been discovered that the optimum cleaning/degreasing efficacy is attained by utilizing an organic solvent of inherently low or limited water solubility and rendering it just completely water soluble by means of one or more solubilizing additives, i.e. by employing a sparingly water soluble organic solvent and teasing it into complete solution by the addition of a minimum amount of one or more solubilizing additives. Unexpectedly, it has also been found that the addition of an excess of a solubilizing additive over that required to completely solubilize the sparingly soluble organic solvent somewhat lowers or detracts from the degreasing efficacy of the cleaner/degreaser composition as experimentally demonstrated hereinafter. Further, the optimum cleaning-/degreasing efficacy is achieved by utilizing organic solvents which have limited water solubility in the range of approximately 0.2 to approximately 6 weight percent of the total composition, organic solvents with water solubilities outside this range appearing to provide less effective cleaning/degreasing action. Thus, it is critical to the present invention that a sparingly water soluble organic solvent be optimally formulated with a solubilizing additive in order to maintain minimal aqueous solubility of the solvent.

In the past, highly or infinitely water soluble solvents have been used in cleaner/degreaser compositions, but such solvents are too hydrophilic to effectively remove hydrophobic or oleophilic soilants from surfaces to which such compositions are applied. On the other hand, the present invention permits the practical and effective use of normally hydrophobic (oleophilic) solvents which have great affinity for and dissolving action against oleophilic soilants. It is believed that such sparingly water soluble organic solvents, formulated in accordance with the present invention, lose less of their oily soilant solvency in aqueous solution than their more hydrophilic counterparts because of their borderline aqueous solubility, attained and maintained by the judicious use of solvating surfactants and couplers. Therefore, the solvents of limited solubility used herein are better able to maintain their soilant dissolving, dispersing and suspending action than highly or infinitely water soluble solvents. Consequently, when optimally formulated to maintain minimal aqueous solubility as herein described, the totally aqueous cleaner/degreaser compositions of this invention containing limited water soluble solvents exhibit truly superior oily soilant solvent action. Moreover, the compositions of the invention are true aqueous solutions rather than emulsions or microemulsions as evidenced by the fact that they exhibit no Tyndall effect.

For use in the present invention, the sparingly water soluble organic solvent must have the following characteristics:

(a) it must have limited water solubility in the range of approximately 0.2 to 6 weight percent;
(b) it must not be a hydrocarbon or halocarbon;
(c) it must have one or more similar or dissimilar oxygen, nitrogen, sulfur or phosphorous containing functional groups;
(d) it must be a solvent for hydrophobic soilants; and
(e) it must be present in an amount exceeding its limited aqueous solubility.

Organic solvents meeting these criteria provide superior cleaning/degreasing action when formulated in accordance with the invention.

The principal classes of organic solvents from which useful organic solvents may be selected include esters, alchohols, ketones, aldehydes, ethers and nitriles. These will generally contain one or more of the desired similar or dissimilar functional groups listed above. Examples of organic solvents containing similar functional groups from among those listed above include diethyl gluterate (2 ester groups), phenacyl acetone (2 keto groups), diethylethylene diphosphonate (2 phosphonate ester groups), ethylenedipropionate (2 ester groups), decylene glycol (2 hydroxyl groups), m-dimethoxybenzene (2 ether groups), adiponitrile (2 nitrile groups), ethylene glycol dibutyl ether (2 ether groups), and diethyl-o-phthalate (2 ester groups). Among organic solvents containing dissimilar functional groups from among those listed above may be mentioned 2-phenoxyethanol (hydroxy, ether groups), 1-phenoxy-2-propanol(hydroxy, ether groups), N-phenylmorpholine(amino, ether groups), isopropylacetoacetate (keto, ester groups), o-methoxybenzyl alcohol (ether, hydroxy groups), 4'-methoxyacetophenone (ether, ketone groups), o-nitrophenetole (nitro, ether groups), 2-hexoxyethanol (hydroxy, ether groups), ethylcyanoacetoacetate (cyano, keto, ester groups), p-anisaldehyde (ether, aldehyde groups), polypropylene glycol 1200 (ether, hydroxyl groups), n-butoxy acetate (ether, ester groups), and 2-phenylthioethanol (thioether, hydroxyl groups).

In addition to the criteria listed above, it is also desirable but not essential that the organic solvent have a relatively low volatility or high flash point, exhibit a low level of odor, be chemically stable, nontoxic, nonhazardous and commercially available.

The sparingly water soluble organic solvents which may be employed in the practice of the present invention (and comprising some of the solvents listed above) together with their aqueous ambient temperature solubility in wt. % include 2-phenoxyethanol (2.3) (marketed under the trade designation "Dowanol EPh"), 1-phenoxy-2-propanol (1.1) (marketed under the trade designation "Dowanol PPh"), β-phenylethanol (1.6), acetophenone (0.5), benzyl alcohol (4.4), benzonitrile (1.0), n-butyl acetate (0.7), n-amyl acetate (0.25), benzaldehyde (0.3), N,N-diethylaniline (1.4), diethyl adipate (0.43), dimethyl-o-phthalate (0.43), n-amyl alcohol (2.7), N-phenylmorpholine (1.0), n-butoxyethyl acetate (EB acetate) (1.1), cyclohexanol (4.2), polypropylene glycol 1200 (2), cyclohexanone (2.3), isophorone (1.2), methylisobutyl ketone (2.0), methylisoamyl ketone (0.5), tri-n-butylphosphate (0.6), 1-nitropropane (1.4), nitroethane (4.5), dimethyl esters of mixed succinic, glutaric and adipic acids (5.7) (marketed under the trade designation "DBE ester" by DuPont), diethyl glutarate (0.88), and diethyl malonate (2.08). As will be apparent to those skilled in the art, the above-listed sparingly water soluble organic solvents are merely illustrative and various other solvents meeting the criteria set out above may also be utilized in the practice of the invention. Because of their performance characteristics, lack of odor, low volatility/high flash point, chemical stability and availability, 2-phenoxyethanol and 1-phenoxy-2-propanol are the preferred organic solvents of choice. N-butoxyethyl acetate (EB acetate) and the dimethyl esters of mixed succinic, glutaric and adipic acids are also among the preferred organic solvents.

As indicated, a number of otherwise potent organic solvents having an aqueous solubility of less than approximately 0.2 weight percent such as 2-(2-ethylhexoxy)ethanol (2-ethylhexyl cellosolve) having an aqueous solubility of only 0.095 wt. %, and 2,6-dimethyl-4-heptanone (diisobutyl ketone) (aq. sol. 0.05 wt. %), and organic solvents having an aqueous solubility in excess of approximately 6 weight percent such as propylene glycol monomethyl ether acetate (aq. sol. 16.5 wt. %), ethylene glycol diacetate (aq. sol. 14.3 wt. %), propylene carbonate (aq. sol. 19.6 wt. %) and N-methyl pyrrolidone (infinite aq. sol.) are not useful in the practice of the invention.

In formulating the stable, aqueous cleaner/degreaser compositions of the invention, an organic solvent meeting the required criteria is combined with a solubilizing additive and water. The solubilizing additive consists of from approximately 0.1 to approximately 100 weight percent of a surfactant and from 0 to approximately 99.9 weight percent of a coupler and the solubilizing additive is preferably present in the formulated composition in an amount not substantially exceeding that required to completely solubilize the particular organic solvent being used, i.e. a minimum level of the solubilizing additive is used in order to render the organic solvent "barely soluble" in the aqueous solution so as to achieve maximum or optimum degreasing action. The amount of solubilizing agent (surfactant or surfactant plus coupler) required to accomplish this objective will vary depending upon the particular organic solvent employed and can readily be determined by simple experimentation in each instance.

While it is highly preferred in formulating the compositions of the invention that the solubilizing additive be present in an amount not substantially exceeding that required to completely solubilize the sparingly water soluble organic solvent, useful results are obtainable by employing up to and not more than tenfold the amount necessary to render the organic solvent "barely soluble". Thus, in order to obtain optimum results, the solubilizing agent is present in the minimum amount or up to twofold the minimum amount necessary to just solubilize the organic solvent. As the amount of solubilizing additive increases, the cleaning/degreasing efficacy tends to decrease. However, amounts of solubilizing additive up to tenfold the minimum amount necessary to solubilize the organic solvent provide cleaning/degreasing efficacy better than or at least approximately equal to that of commercially available compositions such as "Fantastik" (Texize/Dow).

The solubilizing additive used in the practice of the invention may consist of a surfactant or a surfactant in combination with a coupler. As used herein, the term "coupler" is intended to mean a hydrotrope or a substance that increases the solubility in water of another material which is only partially water soluble, such as organic solvents or surfactants. In some instances, the use of a surfactant alone will suffice to render the organic solvent component of the compositions just completely soluble while in other instances the use of a surfactant in combination with a coupler may be utilized to achieve the desired complete aqueous solubilization of the organic solvent. Whether or not a surfactant alone or the combination of a surfactant and coupler is to be used is dependent upon the particular organic solvent and surfactant employed and can readily be determined in each particular case by simple experimentation.

The surfactant used may be an anionic, nonionic, cationic or amphoteric surfactant, and the use of anionic or nonionic surfactants is generally preferred, especially for hard surface cleaning/degreasing. Illustrative anionic surfactants for use in the invention include dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly(ethyleneoxy)(10)ethyl sulfonate, potassium octylphenoxypoly(ethyleneoxy)(9)ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium diisobutylsulfosuccinate, disodium laurylsulfosuccinate, tetrasodium N-laurylsulfosuccinimate, sodium decyloxypoly(ethyleneoxy(5)methyl)carboxylate, sodium octylphenoxypoly(ethyleneoxy(8)methyl)carboxylate, sodium mono decyloxypoly(ethyleneoxy)(4)phosphate, sodium di decyloxypoly(ethyleneoxy)(6)phosphate, and potassium mono/di octylphenoxypoly(ethyleneoxy)(9)phosphate. Other anionic surfactants known in the art may also be employed.

Among the useful nonionic surfactants which may be employed may be mentioned octylphenoxypoly(ethyleneoxy)(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy) (12)ethanol, methoxypoly(oxyethylene(10)/(oxypropylene(20) )-2-propanol block copolymer, nonyloxypoly(propyleneoxy)(4)/(ethyleneoxy)(16)ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy) (8) ethanol, coconut diethanolamide, "modified", and coconut diethanolamide, "long chain modified". Other known nonionic surfactants may likewise be used.

Illustrative useful cationic surfactants include a mixture of n-alkyl ($C_{12}$ 50%, $C_{14}$ 30%, $C_{16}$ 17%, $C_{18}$ 3%) dimethyl ethylbenzyl ammonium chlorides, hexadecyltrimethylammonium methosulfate, didecyldimethylammonium bromide and a mixture of n-alkyl (68% $C_{12}$, 32% $C_{14}$) dimethyl benzyl ammonium chlorides. Similarly useful amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine. Other cationic and amphoteric surfactants known to the art may also be utilized.

The preferred surfactants for general use in the practice of the invention include dodecylbenzenesulfonic acid and the sodium, potassium, triethanolamine, morpholinium, ammonium and isopropylamine salts thereof, and morpholinium tallate.

The couplers which may be utilized in the practice of the invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoglycinate. Certain water-soluble solvents known to the art as couplers such as propylene glycol ethers (e.g. tripropyleneglycol monomethyl ether) can be used in the practice of the invention, but cannot be substituted for the sparingly water soluble organic solvent component. Additional couplers or hydrotropes known to the art may also be utilized.

In regard to the solubilizing additive component of the compositions of the invention, it will be understood that one or more surfactants from one or more compatible classes of surfactants may be employed or utilized in a mixed solubilizing surfactant system. For example, a combination of compatible anionic and nonionic surfactants may be employed. Likewise, a combination of compatible couplers may also be used as may a combination of one or more compatible surfactants from different classes of surfactants together with one or more couplers. Thus, one may use a combination of blended surfactants and couplers to achieve the desired minimal solvent solubilization. The compatibility of the various surfactants and of the various couplers with each other and in combination can be readily determined by simple experimentation.

Similarly, but less preferably, a mixture of the sparingly soluble organic solvents may be employed in formulating the compositions of the invention. However, if a mixture of solvents is to be used, each of the solvents should have nearly the same approximate water solubility so that they will solubilize in water at approximately the same point upon addition of the solubilizing additive.

In addition to the organic solvent and solubilizing additive components of the compositions of the invention, various optional adjuvants can be incorporated. These include chelants such as the sodium salts of ethylenediaminetetraacetic acid (Hampene 100 or Versene 100), thickeners such as carboxy acrylic polymers (Carbopol 940) or acrylic acid/alkyl methacrylate copolymers (Acrysol ICS-1), fragrances, dyes, pH adjustants, anti-corrosion additives and anti-rust additives. In general, it is preferred that the compositions be formulated to have a pH of about 7.0 so as to be gentle to the hands and avoid defatting the skin.

While the various components comprising the resultant compositions may generally be brought together in any prescribed order under mechanical mixing conditions at ambient temperatures, it is often found expeditious to either add water slowly to the stirred, blended organic components or to add the premixed organics to water with agitation. "Clearing" of the mixture, or transformation from heterogeneous suspension to fully soluble aqueous solution, usually occurs within several minutes' stirring.

The concentration of the aqueous cleaner/degreaser solution, as indicated by the terms "total solids content" and "total actives content" in the working examples provided hereinafter refers, respectively, to the combined percentages of nonvolatile components and to the sum total of nonaqueous volatile and nonvolatile components.

The term "cloud point" indicates the temperature below which the composition exists as a clear, single phase solution and above which phase separation (heterogeneity) occurs. For practical reasons, a composition should preferably have a cloud point in excess of, for example 50° C., to have a viably safe, storage-stable shelf life under hot, summertime warehouse conditions.

It is to be expected that, as the concentration of a given organic solvent is increased (with necessary concomitant increase in solubilizing additive), the rate at which cleaning/degreasing is accomplished likewise increases and improved cleaning/degreasing efficacy can be realized. Conversely, as the organic solvent concentration is lowered, either by diluting a given composition with water or through changes made in formulating the cleaner/degreaser composition, the cleaning-/degreasing rate is generally lowered and efficacy can be said to diminish or lessen. Thus, the concentration, as measured by "total solids content" and "total actives content" can be adjusted to any given or desired level within the parameters, criteria, and constraints imposed on the practice of the invention, and within the normal, viable operational limits encountered in formulating the components of said compositions. Thus, it is possible to formulate water soluble solution concentrates provided enough solubilizing additive is used to completely solubilize the organic solvent, and that upon dilution, the cleaning/degreasing efficacy is only gradually diminished by reason of the larger volume of water present (see results set forth in Examples 3 and 6 hereinafter).

As shown by the experimental degreasing test data presented below, the compositions of the invention provide superior cleaning/degreasing efficacy over that achievable with commercially available cleaner/degreasing compositions. Thus, the commercial product "Fantastik" (Texize/Dow) required 9 hours to achieve 100% removal of grease by the degreasing test method hereinafter described whereas the compositions of the present invention achieve 100% removal of grease in a matter of several minutes.

The following examples illustrate the practice of the invention.

EXAMPLE 1

In the following examples of illustrative cleaner/degreaser compositions of the present invention, the compositions were subjected as indicated to the definitive, semiquantitative degreasing test method described below in order to measure their cleaning/degreasing efficacy.

A magnetic stirrer (Fisher Scientific Co., Catalog No. 14-511-1A) provided with a vaned disc magnetic stir bar ($\frac{7}{8}''$ (diameter)$\times\frac{5}{8}''$ (height), 22 mm$\times$15 mm, Fisher Scientific Co., Catalog No. 14-511-98C) was used. In each instance, pre-cleaned, borosilicate glass microslides (3"$\times$ 1", 1.0 mm thickness) were thinly smeared/-rub-on coated with Vaseline brand white petroleum jelly on one side only to a distance of 1.0" from the bottom edge to provide a 1.0"$\times$1.0" coated area. The test cleaner/degreaser solutions were employed at full strength unless otherwise indicated and in an amount sufficient to fill a 50 ml Pyrex beaker containing the vaned disc magnetic stirrer bar to a level of 40 ml. Each test solution and surrounding air were maintained at 21 $\pm$0.5° C. and the test solution stirring rate was determined by a setting of "3" on the stirrer dial of the magnetic stirrer. The stirring disc was positioned off-center to accomodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test cleaning/degreasing solution at the indicated concentration, placed atop the magnetic stirrer plate, and positioned off-center to accomodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the cleaner/degreaser solution bath and immediately "read" for "% Vaseline removed from the 1.0"×1.0" treated area", an objective determination, after which the microslide was immediately returned to the stirred aqueous cleaner/degreaser bath. The duration of the degreasing test is determined by the time needed for complete, 100% removal of the Vaseline film from the glass microslide surface.

The accuracy of the above-described test method is of the order of ±5% as determined by replicate run averaging.

EXAMPLE 2

An aqueous cleaner/degreaser formulation was prepared having the following composition:

| Component | Wt. % |
|---|---|
| 2-Phenoxyethanol (Dowanol EPh) | 8.0 |
| Dodecylbenzenesulfonic acid | 1.2 |
| Sodium hydroxide (50%) | 0.3 |
| Chelant (Hampene 100) | 0.6 |
| Water soluble dye blend | 0.002 |
| Soft $H_2O$ | 189.9 |
| | 200.0 |

The composition was a clear, aqueous solution having a pH of 7.0, a total solids content of 0.80 wt. %, a total actives content of 4.80 wt. % and a cloud point in excess of 100° C.

This composition was subjected to the degreasing test method described in Example 1 with the following results:

1st attack on greased slide at 5 sec.
25% removal of grease at 20 sec.
50% removal of grease at 30 sec.
85% removal of grease at 1.0 min.
100% removal of grease at 1.25 min.

The composition exhibited very superior cleaning/degreasing action on grease, oil, smudges, black Magic Marker markings, ballpoint pen markings, pencil markings, etc. found on any washable surface.

EXAMPLE 3

An aqueous cleaner/degreaser concentrate formulation was prepared having the following composition:

| Component | Wt. % |
|---|---|
| 2-Phenoxyethanol | 30.0 |

-continued

| Component | Wt. % |
|---|---|
| (Dowanol EPh) | |
| Sodium xylene sulfonate (40%) | 30.0 |
| Dodecylbenzenesulfonic acid | 3.6 |
| Chelant (Hampene 100) | 2.0 |
| Sodium hydroxide (50%) | 0.7 |
| Water soluble dye blend | 0.002 |
| Soft $H_2O$ | 133.7 |
| | 200.00 |

The concentrate was a clear, aqueous solution having a pH of 7.0, a total solids content of 8.375%, a total actives content of 23.4% and a cloud point in excess of 100° C.

This concentrate, at the various dilutions with water indicated below, was subjected to the degreasing test method of Example 1 with the following results:

At a dilution of 1 part concentrate: 3 parts $H_2O$
1st attack on greased slide at 7 sec.
60% removal of grease at 30 sec.
80–85% removal of grease at 1.0 min.
100% removal of grease at 2.0 min.

At a dilution of 1:4
1st attack on greased slide at 10 sec.
50% removal of grease at 30 sec.
70–75% removal of grease at 1.0 min.
100% removal of grease at 2.25 min.

At a dilution of 1:5
1st attack on greased slide at 12 sec.
25% removal of grease at 30 sec.
40% removal of grease at 1.0 sec.
65% removal of grease at 2.0 min.
85–90% removal of grease at 3.0 min.
100% removal of grease at 4.0 min.

At a dilution of 1:10
1st attack on greased slide at 15 sec.
15–20% removal of grease at 1.0 min.
30% removal of grease at 2.0 min.
50–55% removal of grease at 3.0 min.
80–85% removal of grease at 4.0 min.
100% removal of grease at 5.25 min.

At a dilution of 1:20
1st attack on greased slide at 22 sec.
10–15% removal of grease at 1.0 min.
25% removal of grease at 2.0 min.
40% removal of grease at 3.0 min.
65–70% removal of grease at 4.0 min.
85% removal of grease at 5.0 min.
100% removal of grease at 6.0 min.

EXAMPLE 4

An aqueous cleaner/degreaser formulation was prepared having the following composition.

| Component | Wt. % |
|---|---|
| 2-Phenoxyethanol (Dowanol EPh) | 4.0 |
| Tall oil carboxylic acids | 0.70 |
| Morpholine | 0.60 |
| Soft $H_2O$ | 94.7 |
| | 100.0 |

The tall oil carboxylic acids and morpholine form morpholinium tallate, an amine salt or soap which functions as an anionic surfactant/coupler. The composition was a clear, essentially colorless, low foaming, aqueous solution having a pH of 8.83, a total solids content of 1.3%, a total actives content of 5.3% and a cloud point in excess of 100° C.

This composition was subjected to the degreasing test method of Example 1 with the following results:
1st attack on greased slide at about 1 sec.
80% removal of grease at 10 sec.
100% removal of grease at 15 sec.
The composition very easily and readily effects the total removal of the following markings from alkyd enameled metal surfaces: black Magic Marker felt pen, blue and black indelible ballpoint pen and #1 hardness pencil.

EXAMPLE 5

An aqueous cleaner/degreaser formulation was prepared having the following composition:

| Component | Wt. % |
|---|---|
| 1-Phenoxy-2-propanol (Dowanol PPh) | 4.0 |
| Dodecylbenzenesulfonic acid | 1.5 |
| Sodium hydroxide (50%) | 0.4 |
| Soft $H_2O$ | 94.1 |
| | 100.0 |

The composition was a clear, colorless, aqueous solution having a pH of 7.0, a total solids content of 1.7%, a total actives content of 5.7% and a cloud point in excess of 100° C. The composition exhibited no flash point (extinguishes flame) and was essentially odorless.

The composition was subjected to the degreasing test method of Example 1 with the following results.
1st attack on greased slide at 4 sec.
35% removal of grease at 15 sec.
60% removal of grease at 30 sec.
80% removal of grease at 45 sec.
90–95% removal of grease at 1.0 min.
100% removal of grease at 1.20 min.
The composition easily and fully removed the following markings from alkyd enameled metal surfaces: black Magic Marker felt pen, blue and black indelible ballpoint pen, #1 hardness pencil, and red (wax) crayon.

EXAMPLE 6

An aqueous cleaner/degreaser high concentrate formulation was prepared having the following composition:

| Component | Wt. % |
|---|---|
| 2-Phenoxyethanol (Dowanol EPh) | 60.0 |
| Dodecylbenzenesulfonic acid | 10.0 |
| Sodium hydroxide (50%) | 2.7 |
| Sodium xylene sulfonate (40%) | 12.3 |
| Soft $H_2O$ | 15.0 |
| | 100.0 |

The concentrate was a clear, pale yellow, aqueous solution having a pH of 7.0, a total solids content of 16.27%, a total actives content of 76.27% and a cloud point in excess of 100° C. The concentrate exhibited no flash point up to 200° F. and had a very bland odor.

A clear, colorless, aqueous solution was formed by diluting 1 part of the concentrate with 15 parts of water. The diluted solution was subjected to the degreasing test method of Example 1 with the following results:
1st attack on greased slide at 4 sec.
33% removal of grease at 30 sec.
65% removal of grease at 1.0 min.
85% removal of grease at 1.5 min.
100% removal of grease at 2.0 min.
The diluted solution easily and totally removed the following markings from alkyd enameled metal surfaces: black indelible Magic Marker felt pen, blue and black indelible ballpoint pen, #1 hardness pencil and red (wax) crayon.

EXAMPLE 7

An aqueous cleaner/degreaser concentrate formulation was prepared having the following composition:

| Component | Wt. % |
|---|---|
| 1-Phenoxy-2-propanol (Dowanol PPh) | 15.0 |
| Dodecylbenzenesulfonic acid | 4.0 |
| Sodium hydroxide (50%) | 1.0 |
| Sodium xylene sulfonate (40%) | 19.0 |
| Soft $H_2O$ | 61.0 |
| | 100.0 |

The concentrate was a very clear, slightly straw colored, aqueous solution having a pH of 7.0, a total solids content of 12.1%, a total actives content of 27.1% and a cloud point in excess of 100° C. The concentrate exhibited no flash point and had essentially no odor.

Upon diluting 1 part of the concentrate with 5 parts of water, a faint bluish microemulsion was formed. The diluted concentrate was subjected to the degreasing test method of Example 1 with the following results:
1st attack on greased slide at 5 sec.
15–20% removal of grease at 30 sec.
33% removal of grease at 1.0 min.
55% removal of grease at 2.0 min.
80–85% removal of grease at 3.0 min.
90% removal of grease at 3.5 min.
100% removal of grease at 4.25 min.
The diluted composition easily and fully removed the following markings from alkyd enameled metal surfaces: black indelible Magic Marker felt pen, blue and black indelible ballpoint pen, #1 hardness pencil and red (wax) crayon.

EXAMPLE 8

An aqueous cleaner/degreaser formulation was prepared having the following composition:

| Component | Wt. % |
|---|---|
| 1-Phenoxy-2-propanol (Dowanol PPh) | 15.0 |
| Dodecylbenzenesulfonic acid | 5.4 |
| Sodium xylene sulfonate (40%) | 8.0 |
| Sodium hydroxide (50%) | 1.4 |
| Soft $H_2O$ | 70.2 |
| | 100.0 |

The concentrate was a clear, very pale straw colored, aqueous solution having a pH of 7.0, a total solids content of 9.3%, a total actives content of 24.3% and a cloud point in excess of 100° C. The concentrate exhibited no flash point and was essentially odorless.

Upon diluting 1 part of the concentrate with 3 parts of water, a bluish microemulsion was formed. The diluted concentrate was subjected to the degreasing test method of Example 1 with the following results:
1st attack on greased slide at 5–6 sec.
20–25% removal of grease at 30 sec.
35% removal of grease at 1.0 min.
50% removal of grease at 1.5 min.
70% removal of grease at 2.0 min.
80–85% removal of grease at 2.5 min.
90–95% removal of grease at 3.0 min.
100% removal of grease at 3.5 min.
The diluted composition easily and fully removed the same markings as were removed by the diluted composition of Example 6.

EXAMPLE 9

An aqueous cleaner/degreaser formulation was prepared having the following composition:

| Component | Wt. % |
|---|---|
| 2-Phenoxyethanol (Dowanol EPh) | 4.0 |
| Dodecylbenzenesulfonic acid | 6.0 |
| Sodium hydroxide (50%) | 1.6 |
| Chelant (Hampene 100) | 0.3 |
| Water soluble dye blend | 0.001 |
| Soft $H_2O$ | 88.1 |
| | 100.00 |

The composition was a clear, aqueous solution having a pH of 7.0, a total solid content of 6.9%, a total actives content of 10.9% and a cloud point in excess of 100° C.

The above composition is similar to that of Example 2 except that it contains a tenfold increase in the amount of the solubilizing additive, dodecylbenzenesulfonic acid. While the composition of Example 2 exhibited very superior cleaning/degreasing action on grease, oil, smudges, black Magic Marker markings, ballpoint pen markings, pencil markings, etc. involving their complete 100% removal, the above composition gave the following cleaning/degreasing results:

| % Soilant Removal | |
|---|---|
| Soilant | % Removed |
| Graphite pencil | 100 |
| black Magic Marker felt pen | 10–15 |
| blue ballpoint pen (indelible) | 5 |
| black ballpoint pen (indelible) | 5 |
| automotive grease | 50 |
| red (waxy) crayon | 100 |
| "Takilube" outside gear lubricant | 40 |

above results were obtained upon 10 seconds light rubbing with a Kimwipe tissue wetted with the above composition. Thus, while not as effective as the composition of Example 2, the above composition nevertheless functions well in removing greasy, waxy, oily soils from surfaces and is comparable in many respects to ready to use industrial and retail grade cleaner/degreaser compositions.

The composition was subjected to the degreasing test method of Example 1 with the following results:
1st attack on greased slide at 25 min.
5% removal of grease at 1.0 hr.
5–10% removal of grease at 2.0 hr.
15–20% removal of grease at 3.5 hr.
33% removal of grease at 5.0 hr.
45% removal of grease at 6.5 hr.
60% removal of grease at 8.0 hr.
75% removal of grease at 10.5 hr.
85–90% removal of grease at 12.0 hr.
95% removal of grease at 14.5 hr.
100% removal of grease at 15.0 hr.

EXAMPLE 10

An aqueous cleaner/degreaser aerosol formulation was prepared having the following composition:

| Component | Wt. % |
|---|---|
| 2-Phenoxyethanol (Dowanol EPh) | 3.0 |
| Sodium pelargonate (45%) (Monatrope 1250) | 7.2 |
| Octylphenol ethoxylate (Triton X-45) | 0.2 |
| Sodium nitrite | 0.2 |
| Ammonium hydroxide (28% $NH_3$) | 0.05 |
| Deionized $H_2O$ | 89.35 |
| | 100.00 |

The composition was a clear, colorless aqueous solution having a pH of 10.24.

The above composition was aerosolized in a 6 oz. aerosol can using 8.32 g (15.8 ml) of a propane-isobutane blend propellant (sold under the trade designation A-55) through an AR-75 valve. The fill ratio equaled 87/13. The valve was fitted with a Marc-18-1525 actuator.

It was found that the resulting aerosol formulation very easily and quickly removed all of the following markings from alkyd enameled metal surfaces: black, indelible Magic Marker felt pen, blue and black indelible ballpoint pen, red (wax) crayon and automotive grease smearings.

EXAMPLE 11

An aqueous cleaner/degreaser formulation was prepared having the following composition:

| Component | Wt. % |
|---|---|
| Benzaldehyde | 3.0 |
| Dodecylbenzenesulfonic acid | 3.0 |
| Sodium hydroxide (50%) | 0.75 |
| Sodium 1-octanesulfonate (Bio Terge PAS-8S) | 3.0 |
| Chelant (Hampene 100) | 0.3 |
| Soft $H_2O$ | 89.95 |
| | 100.00 |

composition was a clear, aqueous solution having a pH of 7.0, a total solids content of 4.7%, a total actives content of 7.70% and a cloud point in excess of 100° C.

The composition was subjected to the degreasing test method of Example 1 with the following results:
1st attack on greased slide at 5 sec.
20% removal of grease at 30 sec.
35–40% removal of grease at 1.0 min.
60% removal of grease at 2.0 min.
75–80% removal of grease at 3.0 min.
100% removal of grease at 5.0 min.

EXAMPLE 12

An aqueous cleaner/degreaser formulation was prepared having the following composition:

| Component | Wt. % |
|---|---|
| Methyl isobutyl ketone | 3.5 |
| Dodecylbenzenesulfonic acid | 2.25 |
| Sodium hydroxide (50%) | 0.6 |
| Sodium 1-octanesulfonate (Bio Terge PAS-8S) | 3.0 |
| Chelant (Hampene 100) | 0.3 |
| Soft $H_2O$ | 90.35 |
| | 100.00 |

The composition was a clear, aqueous solution having a pH of 7.0, a total solids content of 3.8%, a total actives content of 7.37% and a cloud point in excess of 100° C.

The composition was subjected to the degreasing test method of Example 1 with the following results:
1st attack on greased slide at 4 sec.
25% removal of grease at 15 sec.
45–50% removal of grease at 30 sec.
70% removal of grease at 1.0 min.
85% removal of grease at 2.0 min.
100% removal of grease at 3.5 min.

EXAMPLE 13

An aqueous cleaner/degreaser formulation was prepared having the following composition:

| Component | Wt. % |
|---|---|
| Benzonitrile | 3.5 |
| Dodecylbenzenesulfonic acid | 3.6 |
| Sodium hydroxide (50%) | 1.0 |
| Sodium 1-octanesulfonate (Bio Terge PAS-8S) | 3.6 |
| Chelant (Hampene 100) | 0.3 |
| Soft $H_2O$ | 88.0 |
| | 100.0 |

The composition was a clear, aqueous solution having a pH of 7.0, a total solids content of 5.66%, a total actives content of 9.16% and a cloud point in excess of 100° C.

The composition was subjected to the degreasing test method of Example 1 with the following results:
1st attack on greased slide at 6 sec.
10% removal of grease at 30 sec.
15% removal of grease at 1.0 min.
30% removal of grease at 2.0 min.
40% removal of grease at 3.0 min.
50% removal of grease at 4.0 min.
65% removal of grease at 6.0 min.
80–85% removal of grease at 8.0 min.
100% removal of grease at 10 min.

EXAMPLE 14

An aqueous cleaner degreaser formulation was prepared having the following composition:

| Component | Wt. % |
|---|---|
| Cyclohexanone | 5.0 |
| Alkylpolyglycoside (Nonionic surfactant - APG-300) | 1.0 |
| Sodium 1-octanesulfonate (Bio Terge PAS-8S) | 2.5 |
| Chelant (Hampene 100) | 0.3 |
| Citric acid | 0.05 |
| Soft $H_2O$ | 91.15 |
| | 100.00 |

The composition was a clear, aqueous solution having a pH of 7.0, a total solids content of 1.67%, a total actives content of 6.67% and a cloud point in excess of 100° C.

The composition was subjected to the degreasing test method of Example 1 with the following results:
1st attack on greased slide at 1 sec.
60% removal of grease at 15 sec.
75% removal of grease at 30 sec.
100% removal of grease at 1.25 min.
The composition partially removes black Magic Marker markings from enameled metal surfaces.

EXAMPLE 15

An aqueous cleaner/degreaser formulation was prepared having the following composition:

| Component | Wt. % |
|---|---|
| Isophorone | 3.6 |
| Dodecylbenzenesulfonic acid | 1.8 |
| Sodium hydroxide (50%) | 0.45 |
| Chelant (Hampene 100, 40%) | 0.3 |
| Sodium 1-octanesulfonate (Bio Terge PAS-8S) | 3.0 |
| Soft $H_2O$ | 90.85 |
| | 100.00 |

The composition was a clear, aqueous solution having a pH of 7.0, a total solids content of 3.345%, a total actives content of 6.945% and a cloud point in excess of 100° C.

The composition was subjected to the degreasing test method of Example 1 with the following results:
1st attack on greased slide at 1 sec.
65–70% removal of grease at 15 sec.
85–90% removal of grease at 30 sec.
100% removal of grease at 1.0 min.

The composition easily removed Magic Marker markings from enameled metal surfaces and very readily removed smeared automotive grease from fork-lift truck bodies.

EXAMPLE 16

An aqueous cleaner/degreaser formulation was prepared having the following composition:

| Component | Wt. % |
|---|---|
| Butoxyethyl acetate (butyl cellosolve acetate) | 5.0 |
| Dodecylbenzenesulfonic acid | 3.3 |
| Sodium hydroxide (50%) | 0.85 |
| Chelant (Hampene 100, 40%) | 0.3 |
| Sodium 1-octanesulfonate (Bio Terge PAS-8S) | 4.0 |
| Soft $H_2O$ | 86.55 |
| | 100.00 |

The composition was a clear, aqueous solution having a pH of 7.0, a total solids content of 5.445%, a total actives content of 10.44% and a cloud point in excess of 100° C.

The composition was subjected to the degreasing test method of Example 1 with the following results:
1st attack on greased slide at 2 sec.
33% removal of grease at 15 sec.
60–70% removal of grease at 30 sec.
85–90% removal of grease at 1.0 min.
100% removal of grease at 1.5 min.

The composition removed Magic Marker markings from enameled metal surfaces with slight difficulty.

EXAMPLE 17

A formulation was prepared using as the potent organic solvent 2-(2-ethylhexyloxy) ethanol (2-ethylhexyl cellosolve or Ektasolve EEH) whose aqueous solubility is only 0.095 wt. %. The formulation had the following composition:

| Component | Wt. % |
|---|---|
| 2-(2-Ethylhexyloxy) ethanol | 4.0 |
| Dodecylbenzenesulfonic acid | 6.0 |
| Sodium hydroxide (50%) | 1.5 |
| Sodium cumene sulfonate (45%) | 6.0 |
| Soft $H_2O$ | 82.5 |
| | 100.0 |

The composition was an opalescent formulation and not quite a clear solution. The high levels of dodecylbenzenesulfonic acid and sodium cumene sulfonate failed to fully solubilize the organic solvent component. The composition had a pH of 7.0, a total solids content of 9.45%, a total actives content of 13.45% and a cloud point in excess of 100° C.

The composition was subjected to the degreasing test of Example 1 with the following result:

1st attack on greased slide at 10 min.

The composition effected only very slight removal of black Magic Marker markings from enameled metal surfaces and had no effect at all on black ballpoint pen markings.

The organic solvent 2-(2-ethylhexyloxy) ethanol alone very easily removes black Magic Marker and blue and black indelible ballpoint pen, etc. markings from alkyd enameled metal surfaces.

EXAMPLE 18

A formulation was prepared using an amount of surfactant in excess of that required to just aqueous solubilize the organic solvent component of the formulation. The formulation had the following composition:

| Component | Wt. % |
|---|---|
| 2-Phenoxyethanol (Dowanol EPh) | 8.0 |
| Dodecylbenzenesulfonic acid | 4.0 |
| Sodium hydroxide (50%) | 1.0 |
| Chelant (Hampene 100) | 0.6 |
| Water soluble dye blend (1:1 BG/S-545) | 0.002 |
| Soft $H_2O$ | 196.4 |
| | 200.0 |

The composition was a clear, aqueous solution having a pH of 7.0, a total solids content of 2.371%, a total actives content of 6.371% and a cloud point in excess of 100° C.

The composition was subjected to the degreasing test method of Example 1 with the following results:

1st attack on greased slide at 10 sec.
15% removal of grease at 30 sec.
25% removal of grease at 1.0 min.
35–40% removal of grease at 1.5 min.
45–50% removal of grease at 2.0 min.
55% removal of grease at 3.0 min.
70% removal of grease at 5.0 min.
80–85% removal of grease at 8.0 min.
90% removal of grease at 10.0 min.
100% removal of grease at 12.0 min.

The results may be compared with those obtained with the composition of Example 2 which effected 100% removal of grease at 1.25 min. The composition of Example 2 contained an amount of surfactant not substantially exceeding that required to aqueous solubilize the organic solvent component.

The composition of this example totally failed to remove any black Magic Marker markings or black as well as blue ballpoint pen markings from enameled metal surfaces.

| Component | Wt. % |
|---|---|
| 1-Phenoxy-2-propanol (Dowanol PPh) | 4.0 |
| Sodium 1-octanesulfonate (Bio Terge PAS-8S, 40%) | 4.0 |
| Dodecylbenzenesulfonic acid | 1.0 |
| Sodium hydroxide (50%) | 0.25 |
| Chelant (Hampene 100) | 0.3 |
| Soft $H_2O$ | 90.45 |
| | 100.00 |

EXAMPLE 19

An aqueous cleaner/degreaser formulation was prepared having the following composition:

| Component | Wt. % |
|---|---|
| 1-Phenoxy-2-propanol (Dowanol PPh) | 4.0 |
| Sodium 1-octanesulfonate (Bio Terge PAS-8S, 40%) | 4.0 |
| Dodecylbenzenesulfonic acid | 1.0 |
| Sodium hydroxide (50%) | 0.25 |
| Chelant (Hampene 100) | 0.3 |
| Soft $H_2O$ | 90.45 |
| | 100.00 |

The composition was a clear, aqueous solution having a pH of 7.0, a total solids content of 2.85%, a total actives content of 6.85% and a cloud point in excess of 100° C.

The composition was subjected to the degreased test method of Example 1 with the following results:

1st attack on greased slide at 2 sec.
50% removal of grease at 15 sec.
90% removal of grease at 30 sec.
100% removal of grease at 45 sec.

The composition very easily removed black Magic Marker markings from enameled metal surfaces.

EXAMPLE 20

Example 19 was repeated except that the composition contained 10.0 wt. % of the coupler sodium 1-octanesulfonate and 84.45 wt. % of soft $H_2O$, with the other components being present in the same amounts shown in Example 19. The amount of surfactant/coupler components employed in Example 19 did not substantially exceed that required to aqueous solubilize the organic solvent component while the increased amount of the coupler utilized in this example greatly exceeded the amount necessary to aqueous solubilize the organic solvent component.

The resulting composition was subjected to the degreasing test method of Example 1 with the following results:

1st attack on greased slide at 25 sec.
10% removal of grease at 1.0 min.
15% removal of grease at 2.0 min.
20–25% removal of grease at 4.0 min.
40% removal of grease at 7.0 min.
60% removal of grease at 10.0 min.
75–80% removal of grease at 15.0 min.
90–95% removal of grease at 20.0 min.
100% removal of grease at 25.0 min.

The composition smudged or smeared rather than removed black Magic Marker markings and blue and black ballpoint pen markings.

EXAMPLE 21

An aqueous cleaner/degreaser formulation was prepared which contained an organic solvent whose aqueous solubility exceeded 6 weight percent. The organic solvent employed was propylene glycol monomethyl ether acetate having a water solubility of approximately 16.5 wt. %. The formulation had the following composition:

| Component | Wt. % |
|---|---|
| Propylene glycol monomethyl ether acetate | 4.0 |
| Nonylphenoxypoly(ethyleneoxy) (8.5) ethanol (nonionic surfactant-T-Det N-9.5) | 0.35 |
| Chelant (Hampene 100) | 0.3 |
| Citric acid | 0.05 |
| Soft $H_2O$ | 95.3 |
| | 100.00 |

The composition was a clear, aqueous solution having a pH of 7.0, a total solids content of 0.52%, a total actives content of 4.52% and a cloud point of 54° C.

The composition was subjected to the degreased test method of Example 1 with the following results:
1st attack on greased slide at 17 sec.
10% removal of grease at 30 sec.
15–20% removal of grease at 1.0 min.
30% removal of grease at 2.0 min.
40% removal of grease at 3.0 min.
45–50% removal of grease at 4.0 min.
55–60% removal of grease at 5.0 min.
70% removal of grease at 6.0 min.
75–80% removal of grease at 7.0 min.
85–90% removal of grease at 9.0 min.
100 % removal of grease at 11.5 min.

The composition was totally ineffective in attempted removal against the following markings from enameled metal surfaces: black Magic Marker; blue and black indelible ballpoint pen; and #1 hardness pencil. The organic solvent propylene glycol monomethyl ether acetate alone easily removes the above markings from enameled metal surfaces.

EXAMPLE 22

An aqueous cleaner/degreaser formulation was prepared using as the organic solvent 2-butoxyethanol (Butyl Cellosolve) which has an infinite aqueous solubility. The formulation had the following composition:

| Component | Wt. % |
|---|---|
| 2-Butoxyethanol | 4.0 |
| Dodecylbenzenesulfonic acid | 0.60 |

-continued

| Component | Wt. % |
|---|---|
| Sodium hydroxide (50%) | 0.15 |
| Chelant (Hampene 100) | 0.3 |
| Soft $H_2O$ | 94.95 |
| | 100.00 |

The composition was a clear, colorless, aqueous solution having a pH of 7.0, a total solids content of 0.795%, a total actives content of 4.795% and a cloud point in excess of 100° C.

The composition was subjected to the degreasing test method of Example 1 with the following results:
1st attack on greased slide at 20 sec.
10% removal of grease at 40 sec.
20% removal of grease at 1.0 min.
33% removal of grease at 2.0 min
40–45% removal of grease at 3.0 min.
50% removal of grease at 4.0 min.
60% removal of grease at 6.0 min.
70% removal of grease at 8.0 min.
75–80% removal of grease at 11.0 min.
85–90% removal of grease at 15.0 min.
100% removal of grease at 20.5 min.

The composition was totally ineffective in removing the following markings from enameled metal surfaces: black Magic Marker, black and blue indelible ballpoint pen, and #1 hardness pencil, while the organic solvent per se readily removed all of these markings.

The results may be compared with those obtained with the composition of Example 2, and clearly indicate the unsuitability of 2-butoxyethanol in practicing the invention.

EXAMPLE 23

An aqueous cleaner/degreaser formulation was prepared using as the organic solvent N-methylpyrrolidone which has an infinite water solubility. The formulation had the following composition:

| Component | Wt. % |
|---|---|
| N-methylpyrrolidone | 4.0 |
| Dodecylbenzenesulfonic acid | 0.6 |
| Sodium hydroxide (50%) | 0.15 |
| Chelant (Hampene 100) | 0.3 |
| Soft $H_2O$ | 94.95 |
| | 100.00 |

The composition was a clear, colorless, aqueous solution having a pH of 7.0, a total solids content of 0.795%, a total actives content of 4.795% and a cloud point in excess of 100° C.

The composition was subjected to the degreasing test method of Example 1 with the following results:
1st attack on greased slide at 15 sec.
about 5% removal of grease at 30 sec.
33% removal of grease at 1.0 min.
55% removal of grease at 2.0 min.
70% removal of grease at 4.0 min.
80% removal of grease at 6.0 min.
85% removal of grease at 8.0 min.
90% removal of grease at 10.0 min.
95% removal of grease at 13.0 min.
100% removal of grease at 18.0 min.

The composition showed only very slight removal of pencil markings and was ineffective in removing black Magic Marker and blue and black indelible ballpoint pen markings. N-methylpyrrolidone alone is very effective in removing all of these markings from enameled metal surfaces.

EXAMPLE 24

A series of compositions was prepared, each containing 4.0 wt. % of 2-phenoxyethanol (Dowanol EPh) and varying amounts of the anionic surfactant/coupler dodecylbenzenesulfonic acid (DDBSA) from 0.4 wt. % to 3.4 wt. %. These compositions also contained the same relative proportions of sodium hydroxide (50%), chelant and water soluble dye blend. The compositions were subjected to the degreasing test method of Example 1, and the results are summarized in the following table.

TABLE 1

| DDBSA Wt. % | Total Actives % (theory) | Degreasing Time at 21° C., Minutes* | Comments |
|---|---|---|---|
| 0.4 | 4.57 | Not run | Cloudy, Turbid |
| 0.6 | 4.80 | 1.25 | Clear Solution |
| 0.9 | 5.13 | 3.33 | " |
| 1.3 | 5.58 | 6.75 | " |
| 2.0 | 6.37 | 12.0 | " |
| 2.7 | 7.16 | 22.75 | " |
| 3.4 | 7.95 | 50.0 | " |

*Time for complete, 100% degreasing of slide.

These results demonstrate that optimum decreasing efficacy (minimum degreasing time) occurs when the lowest level of solubilizing surfactant and/or coupler are employed so as to minimally but fully solubilize the organic solvent component in the aqueous cleaner/degreaser solution.

EXAMPLE 25

A series of compositions was prepared, each containing 4.0 wt. % of 1-phenoxy-2-propanol (Dowanol PPh) and varying amounts of the coupler sodium 1-octanesulfonate (Bio Terge PAS-8S) from 2.0 wt. % to 15.0 wt. %. These compositions also contained the same relative proportions of dodecylbenzenesulfonic acid (1.0 wt. %), sodium hydroxide (50%) and chelant. The compositions were subjected to the degreasing test method of Example 1, and the results are summarized in the following table.

TABLE 2

| Bio Terge PAS-8S Wt. % | Total Actives % (theory) | Degreasing Time at 21° C., Minutes* | Comments |
|---|---|---|---|
| 2.0 | 6.05 | Not run | Cloudy, Turbid |
| 4.0 | 6.85 | 0.75 | Clear Solution |
| 6.0 | 7.65 | 8.0 | " |
| 8.0 | 8.45 | 17.5 | " |
| 10.0 | 9.25 | 25.0 | " |
| 15.0 | 11.25 | 44.0 | " |

*Time for complete, 100% degreasing of slide.

These results are consistent with the results obtained in Example 24.

EXAMPLE 26

An aqueous cleaner/degreaser formulation was prepared having the following composition:

| Component | Wt. % |
|---|---|
| 2-Phenoxyethanol | 4.0 |

-continued

| Component | Wt. % |
|---|---|
| (Dowanol EPh) | |
| Sodium coco imidazoline amphoglycinate (Monateric CM-36S, 40%) | 2.0 |
| Sodium cumene sulfonate (45%) | 3.3 |
| Citric acid | 0.10 |
| Soft $H_2O$ | 90.6 |
| | 100.00 |

The composition was a clear, colorless, aqueous solution having a pH of 7.02, a total solids content of 2.39%, a total actives content of 6.39% and a cloud point in excess of 100° C.

The composition was subjected to the degreasing test method of Example 1 with the following results:
1st attack on greased slide at 9 sec.
15% removal of grease at 30 sec.
25% removal of grease at 1.0 min.
40% removal of grease at 1.5 min.
65–70% removal of grease at 2.5 min.
90% removal of grease at 3.5 min.
100% removal of grease at 4.25 min.

The composition readily and fully removed the following markings from alkyd enameled metal surfaces: black indelible Magic Marker, blue and black indelible ballpoint pen, #1 graphite pencil and red (wax) crayon.

EXAMPLE 27

An aqueous cleaner/degreaser formulation was prepared having the following composition:

| Component | Wt. % |
|---|---|
| 2-Phenoxyethanol (Dowanol EPh) | 4.0 |
| Dodecylbenzenesulfonic acid, isopropylamine salt (Witconate P10-59) | 0.90 |
| Soft $H_2O$ | 95.1 |
| | 100.0 |

The composition was a clear, colorless, aqueous solution having a pH of 7.0, a total solids content of 0.85%, a total actives content of 4.84% and a cloud point in excess of 100° C.

"The composition was subjected to the degreasing test method of Example 1 with the following results:
1st attack on greased slide at 5 sec.
60% removal of grease at 30 sec.
75–80% removal of grease at 50 sec.
90% removal of grease at 70 sec.
100% removal of grease at 1.5 min.

The composition very easily and completely removed black Magic Marker markings, blue and black indelible ballpoint pen markings and #1 hardness pencil markings from enameled metal surfaces.

EXAMPLE 28

An aqueous cleaner/degreaser formulation was prepared having the following composition:

| Component | Wt. % |
|---|---|
| 2-Phenoxyethanol (Dowanol EPh) | 4.0 |
| Tall Oil carboxylic acids | 0.7 |
| Triethanolamine | 1.0 |

-continued

| Component | Wt. % |
|---|---|
| Soft $H_2O$ | 94.3 |
| | 100.0 |

The tall oil carboxylic acids and triethanolamine formed an amine soap which functioned as an anionic surfactant/coupler. The composition was a clear, essentially colorless, low foaming, aqueous solution with a faint characteristic tall oil odor. It had a pH of 8.21, a total solids content of 1.7%, a total actives content of 5.7% and a cloud point in excess of 100° C.

The composition was subjected to the degreasing test method of Example 1 with the following results:
1st attack on greased slide at 1–2 sec.
90% removal of grease at 15 sec.
100% removal of grease at 20 sec.

The composition very easily, completely and readily removed the following markings from enameled metal surfaces: black Magic Marker, blue and black indelible ballpoint pen and #1 hardness pencil markings.

EXAMPLE 29

The commercial product "Fantastik" All-Purpose Cleaner was analyzed and found to have the following composition:

| Component | Wt. % |
|---|---|
| Ethylene glycol monobutyl ether (Butyl Cellosolve) | 10 ± 2 |
| Sodium salt of dodecylbenzene sulfonic acid | 3.0 |
| Chelant (Versene 100 or Hampene 100) | 0.8 |
| Fragrance & colorant | trace |
| Water | Q.S. |
| | 100.0 |

The composition had a pH of 12.15, a total solids content of 2.98% and a cloud point in excess of 100° C.

The composition was subjected to the degreasing test method of Example 1 with the following results:
1st attack on greased slide at 13 min.
10% removal of grease at 30 min.
11–15% removal of grease at 1 hr.
20% removal of grease at 1.5 hrs.
25% removal of grease at 2.0 hrs.
30–35% removal of grease at 3.0 hrs.
40–45% removal of grease at 3.5 hrs.
55–60% removal of grease at 4.0 hrs.
70% removal of grease at 5.0 hrs.
80% removal of grease at 6.0 hrs.
90% removal of grease at 7.5 hrs.
100% removal of grease at 9.0 hrs.

The composition removed grease/oil buildup on walls, metal surfaces, etc. with comparative ease but required a good scrubbing action.

In view of the above, it will be seen that the several objects of the invention are achieved and other advantageous results attained.

As various changes could be made in the above compositions without departing from the scope of the invention, it is intended that all matter contained in the above description shall be interpreted as illustrative and not in a limiting sense.

What is claimed is:

1. A stable, aqueous cleaner/degreaser composition in the form of a totally water soluble solution comprising:

(a) at least one sparingly water soluble organic solvent characterized by:
  (i) having a water solubility in the range of approximately 0.2 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;
(b) a solubilizing additive consisting of from approximately 0.1 to approximately 100 weight percent of a surfactant and from 0 to approximately 99.9 weight percent of a coupler, said solubilizing additive being present in an amount not exceeding approximately twofold that required to completely solubilize said organic solvent; and
(c) water.

2. A stable, aqueous cleaner/degreaser composition as set forth in claim 1 wherein said solubilizing additive is present in an amount not substantially exceeding that required to completely solubilize said organic solvent.

3. A stable, aqueous cleaner/degreaser composition as set forth in claim 1 wherein said organic solvent has a water solubility in the range of approximately 1 to approximately 2.5 weight percent.

4. A stable, aqueous cleaner/degreaser composition as set forth in claim 1 wherein said organic solvent is selected from the group consisting of esters, alcohols, ketones, aldehydes, ethers and nitriles.

5. A stable, aqueous cleaner/degreaser composition as set forth in claim 1 wherein said organic solvent is further characterized by having a high flash point in excess of 60° C.

6. A stable, aqueous cleaner/degreaser composition as set forth in claim 1 wherein said organic solvent is further characterized by having a low level of odor.

7. A stable, aqueous cleaner/degreaser composition as set forth in claim 1 wherein said organic solvent is selected from the group consisting of 2-phenoxyethanol, 1-phenoxy-2-propanol, β-phenylethanol, acetophenone, benzyl alcohol, butoxyethyl acetate, isophorone and the dimethyl esters of mixed succinic, glutaric and adipic acids.

8. A stable, aqueous cleaner/degreaser composition as set forth in claim 1 wherein said surfactant is selected from the group consisting of anionic, nonionic, cationic and amphoteric surfactants.

9. A stable, aqueous cleaner/degreaser composition as set forth in claim 1 wherein said surfactant is an anionic surfactant selected from the group consisting of dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly(ethyleneoxy) (10)ethyl sulfonate, potassium octylphenoxypoly(ethyleneoxy) (9)ethyl sulfonate, sodium alpha $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium decyloxypoly(ethyleneoxy(5)methyl)carboxylate, sodium octylphenoxypoly(ethyleneoxy(8)methyl)carboxylate, sodium mono decyloxypoly(ethyleneoxy)(4)phosphate, sodium didecyloxypoly(ethyleneoxy)(6)phosphate, and potassium mono/di octylphenoxypoly(ethyleneoxy)(9)phosphate.

10. A stable, aqueous cleaner/degreaser composition as set forth in claim 1 wherein said surfactant is a nonionic surfactant selected from the group consisting of octylphenoxypoly(ethyleneoxy)(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy)(12)ethanol, methoxypoly(oxyethylene(10)/(oxypropylene(20))-2-propanol block copolymer, nonyloxypoly(propyleneoxy)(4)-/(ethyleneoxy) (16)ethanol, dodecyl polyglycoside, polyoxyethylene (9) monolaurate, polyoxyethylene (8) monoundecanoate, polyoxyethylene (20) sorbitan monostrearate, polyoxyethylene (18) sorbitol monotallate, sucrose monolaurate, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy)(8)ethanol, and coconut diethanolamide.

11. A stable, aqueous cleaner/degreaser composition as set forth in claim 1 wherein said surfactant is a cationic surfactant selected from the group consisting of a mixture of n-alkyl dimethyl ethylbenzyl ammonium chlorides, hexadecyltrimethylammonium methosulfate, didecyldimethylammonium bromide and a mixture of n-alkyl dimethyl benzyl ammonium chlorides.

12. A stable, aqueous cleaner/degreaser composition as set forth in claim 1 wherein said surfactant is an amphoteric surfactant selected from the group consisting of cocamidopropyl betaine, sodium palmityloamphopropionate, N-coco beta-aminopropionic acid, disodium N-lauryliminodipropionate, sodium coco imidazoline amphoglycinate and coco betaine.

13. A stable, aqueous cleaner/degreaser composition as set forth in claim 1 wherein said coupler is selected from the group consisting of sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, and sodium n-butoxymethyl carboxylate.

14. A stable, aqueous cleaner/degreaser composition as set forth in claim 1 wherein said water soluble solution additionally comprises one or more optional adjuvants selected from the group consisting of chelants, thickeners, fragrances, dyes, pH adjustants, anti-corrosion additives and anti-rust additives.

15. A stable, aqueous cleaner/degreaser composition as set forth in claim 1 wherein said organic solvent is 2-phenoxyethanol.

16. A stable, aqueous cleaner/degreaser composition as set forth in claim 1 wherein said organic solvent is 1-phenoxy-2-propanol.

17. A stable, aqueous cleaner/degreaser composition as set forth in claim 1 wherein said organic solvent is benzonitrile.

18. A stable, aqueous cleaner/degreaser composition as set forth in claim 1 wherein said organic solvent is benzaldehyde.

19. A stable, aqueous cleaner/degreaser composition as set forth in claim 1 wherein said organic solvent is cyclohexanone.

20. A stable, aqueous cleaner/degreaser composition as set forth in claim 1 wherein said organic solvent is isophorone.

21. A stable, aqueous cleaner/degreaser composition as set forth in claim 1 wherein said organic solvent is N-butoxyethyl acetate.

22. A stable, aqueous cleaner/degreaser composition as set forth in claim 1 wherein said organic solvent is $\beta$-phenylethanol.

23. A stable, aqueous cleaner/degreaser composition as set forth in claim 1 wherein said organic solvent is benzyl alcohol.

24. A stable, aqueous cleaner/degreaser composition as set forth in claim 1 wherein said surfactant is dodecylbenzene sulfonic acid.

25. A stable, aqueous cleaner/degreaser composition as set forth in claim 1 wherein said surfactant is morpholinium tallate.

26. A stable, aqueous cleaner/degreaser composition as set forth in claim 1 wherein said surfactant is octylphenoxypoly(ethyleneoxy)(11)ethanol.

27. A stable, aqueous cleaner/degreaser composition as set forth in claim 1 wherein said surfactant is nonylphenoxypoly(ethyleneoxy)(13)ethanol.

28. A stable, aqueous cleaner/degreaser composition as set forth in claim 1 wherein said coupler is sodium xylene sulfonate.

29. A stable, aqueous cleaner/degreaser composition as set forth in claim 1 wherein said coupler is sodium 1-octanesulfonate.

30. A stable, aqueous cleaner/degreaser composition as set forth in claim 1 wherein said coupler is sodium cumene sulfonate.

31. A stable, aqueous cleaner/degreaser composition in the form of a totally water soluble solution comprising:

(a) 2-phenoxyethanol in an amount exceeding its aqueous solubility;

(b) dodecylbenzenesulfonic acid in an amount not exceeding approximately twofold that required to completely solubilize said 2-phenoxyethanol; and (c) water.

32. A stable, aqueous cleaner/degreaser composition in the form of a totally water soluble solution comprising:

(a) 1-phenoxy-2-propanol in an amount exceeding its aqueous solubility;

(b) a solubilizing additive consisting of dodecylbenzenesulfonic acid and sodium 1-octanesulfonate, said solubilizing additive being present in an amount not exceeding approximately twofold that required to completely solubilize said 1-phenoxy-2-propanol; and (c) water.

* * * * *